US008026852B1

(12) United States Patent
Shor et al.

(10) Patent No.: US 8,026,852 B1
(45) Date of Patent: Sep. 27, 2011

(54) BROADBAND RADIATING SYSTEM AND METHOD

(75) Inventors: Gadi Shor, Tel Aviv (IL); David Meshulam, Hod Hasharon (IL); Jossef Pahima, Karmiel (IL)

(73) Assignee: Wisair Ltd., Tel Aviv (IL)

( * ) Notice: Subject to any disclaimer, the term of this patent is extended or adjusted under 35 U.S.C. 154(b) by 282 days.

(21) Appl. No.: 12/180,537

(22) Filed: Jul. 27, 2008

(51) Int. Cl.
*H01Q 1/36* (2006.01)

(52) U.S. Cl. ..... 343/700 MS; 343/846

(58) Field of Classification Search ..... 343/700 MS, 343/795, 846, 829
See application file for complete search history.

(56) References Cited

U.S. PATENT DOCUMENTS 4,326,203 A * 4/1982 Kaloi ..... 343/700 MS
6,339,402 B1 * 1/2002 McKivergan ..... 343/702
6,667,716 B2 * 12/2003 Chen ..... 343/700 MS
6,859,176 B2 * 2/2005 Choi ..... 343/700 MS
7,106,256 B2 * 9/2006 Watanabe et al. ..... 343/700 MS
7,187,329 B2 * 3/2007 Okado ..... 343/700 MS
7,342,553 B2 * 3/2008 Soler Castany et al. ..... 343/853
7,541,997 B2 * 6/2009 Puente Baliarda et al. ... 343/752
2009/0284419 A1 * 11/2009 Kim et al. ..... 343/700 MS

* cited by examiner

*Primary Examiner* — Tho G Phan
(74) *Attorney, Agent, or Firm* — Reches Patents

(57) ABSTRACT

A broadband radiating device, that includes: a first planar conductive pattern that includes: a symmetrical trapezoid portion in which multiple slots are formed, and a rectangular portion; wherein a long side of the rectangular portion contacts a long side of the symmetrical trapezoid portion; a planar ground pattern; and a planar non-conductive element that separates between the first planar conductive pattern and the planar ground pattern; wherein a narrow end of the symmetrical trapezoid pattern is connected to a feeding area; and wherein the planar ground pattern is adapted to function as a ground of an electrical circuit.

36 Claims, 20 Drawing Sheets

PCB FR4 10 mil' (0.254mm) 0.5 oz 3.1 Gigahertz 3.6 Gigahertz 4.2 Gigahertz 4.8 Gigahertz 6.4 Gigahertz 7 Gigahertz 7.5 Gigahertz 8.5 Gigahertz 9.5 Gigahertz

600

BROADBAND RADIATING SYSTEM AND METHOD

FIELD OF THE INVENTION

This disclosure relates generally to a broadband radiating device, especially in the Gigahertz frequency range and to a method for radiating.

BACKGROUND OF THE INVENTION

Modern devices can wirelessly communicate with each other. Broadband communication facilitates have a high throughput exchange of information but pose various problems to radio frequency component designers that are forced to find satisfactory tradeoffs between radio frequency component performance and size.

Various small broadband antennas have a frequency pattern that dramatically tend to shrink at higher frequencies and also tend to be oriented towards the ground. These unwanted phenomena limit the capability of broadband wireless transmission.

There is a growing need to provide efficient broadband radiation devices.

SUMMARY OF THE PRESENT INVENTION

The present invention provides a method and a device as described in the accompanying claims. Specific embodiments of the invention are set forth in the dependent claims. These and other aspects of the invention will be apparent from and elucidated with reference to the embodiments described hereinafter.

BRIEF DESCRIPTION OF THE DRAWINGS

Further details, aspects, and embodiments of the invention will be described, by way of example only, with reference to the drawings.

DETAILED DESCRIPTION OF THE DRAWINGS

Figure 1:
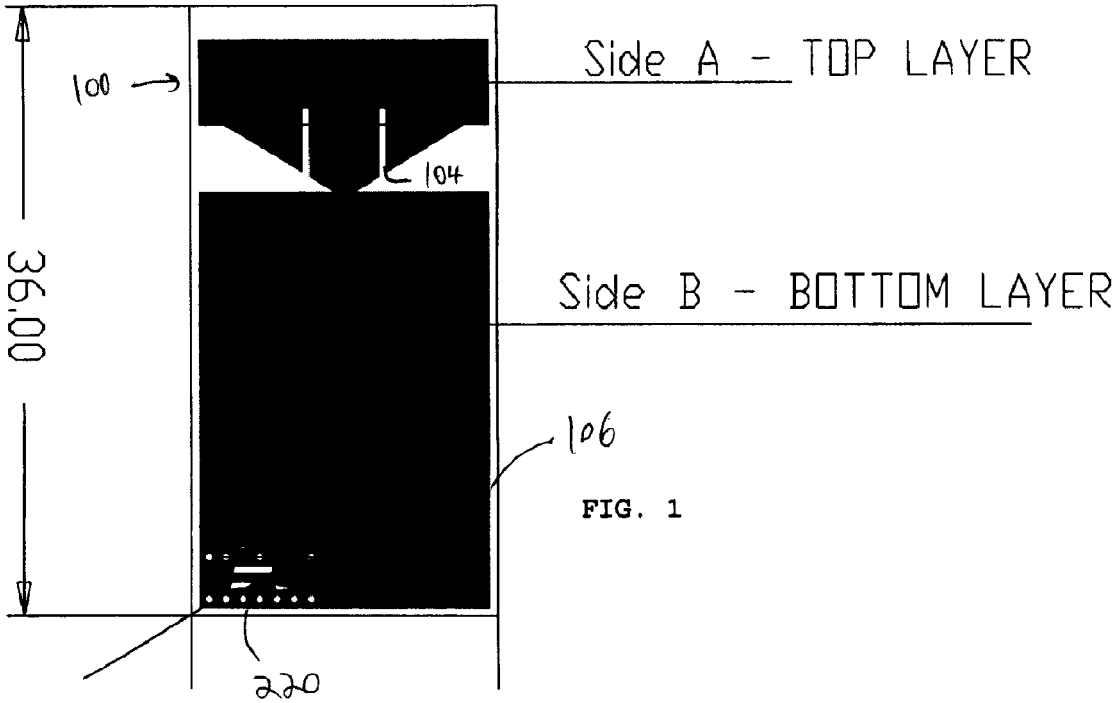
FIG. 1 illustrates a first planar conductive pattern, a ground planar pattern, a feeding conductor and a broadband radio frequency signal source according to an embodiment of the invention.
Figure 2:
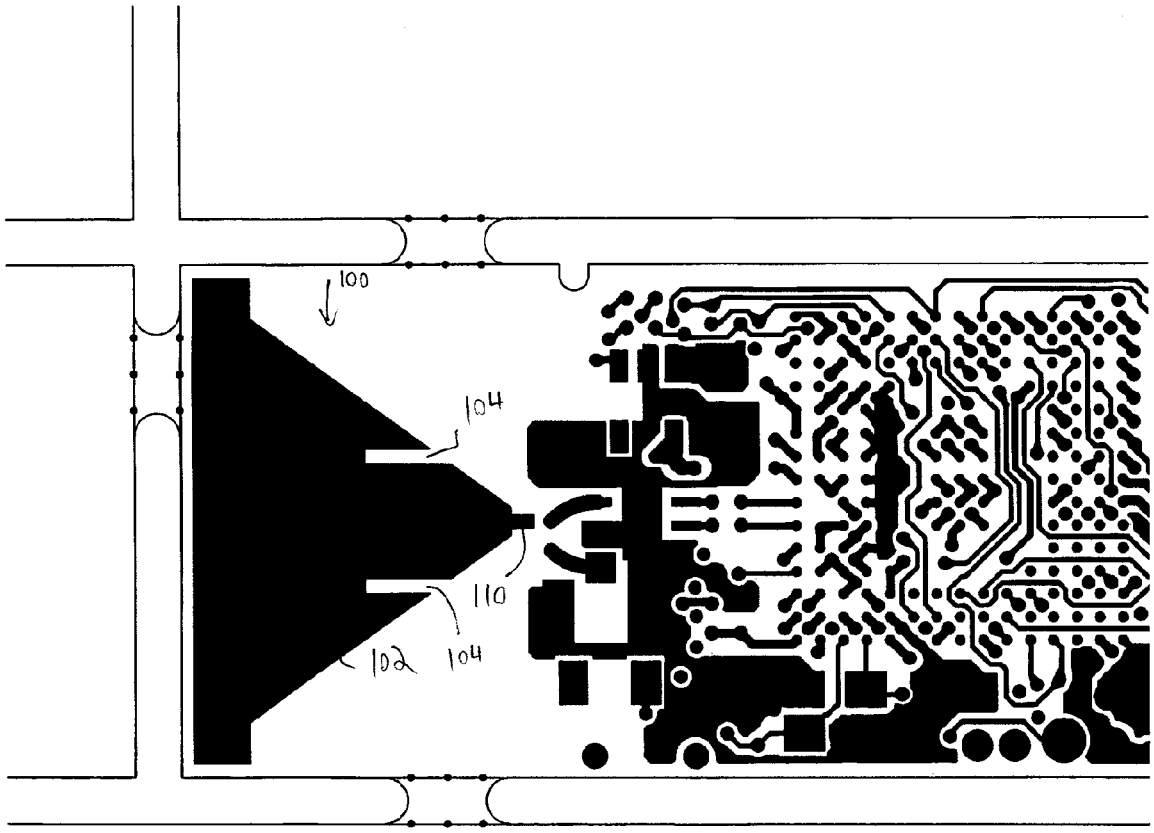
FIG. 2 illustrates a first planar conductive pattern and multiple conductors of an electrical circuit, according to an embodiment of the invention.

In the following specification, the invention will be described with reference to specific examples of embodiments of the invention. It will, however, be evident that various modifications and changes may be made therein without departing from the broader spirit and scope of the invention as set forth in the appended claims.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Before explaining at least one embodiment of the invention in detail, it is to be understood that the invention is not limited in its application to the details set forth herein. The invention can be implemented with other embodiments and can be practiced or carried out in various ways. It is also understood that the phraseology and terminology employed herein is for descriptive purpose and should not be regarded as limiting.

Unless otherwise defined, all technical and scientific terms used herein have the same meaning as commonly understood by one of ordinary skill in the art to which the invention belongs. In addition, the descriptions, materials, methods, and examples are illustrative only and not intended to be limiting. Methods and materials similar or equivalent to those described herein can be used in the practice or testing of the present invention.

A broadband radiating device is provided. It includes at least one planar conductive pattern, a planar ground pattern and at least one planar nonconductive element that separates between multiple planar patterns. Each of the planar conductive patterns and the planar ground pattern includes one or more conductors that can for a pattern. Each planar pattern is substantially flat and can be connected to a planar nonconductive element. Each planar pattern can be relatively thin—for example less than few millimeters thin.

Referring to the examples set fourth in FIGS. 1, 2, 4 and 5, first planar conductive pattern 100 includes: (i) symmetrical trapezoid portion 100 in which multiple slots (for example, slots 104) are formed, and (ii) rectangular portion 106. A long side of the rectangular portion contacts a long side of the symmetrical trapezoid portion 100. These two portions form a continuous pattern. Rectangular portion 106 can extend beyond the symmetrical trapezoid portion 100—the long side of rectangular portion 106 can be longer than the long side of symmetrical trapezoid portion 100. A longitudinal axis of rectangular portion 106 is perpendicular to the symmetrical axis of symmetrical trapezoid portion 100.

Conveniently, two rectangular shaped slots 104 are formed in symmetrical trapezoid portion 100 and each rectangular shaped slot has a longitudinal axis that is substantially perpendicular to the long side of the symmetrical trapezoid portion.

Symmetrical trapezoid portion 100 can be viewed as a truncated triangle that has a narrow end. This narrow end (which corresponds to the narrow side of symmetrical trapezoid portion 100) is connected to feeding area 110 that receives broadband radio frequency signals from an electrical circuit of which planar ground pattern acts as a ground.

Planar ground pattern 200 can have a rectangular shape. It can be much larger than first planar conductive pattern 100 but this is not necessarily so.

Conveniently, even planar ground pattern 200 symmetrical trapezoid portion 100 were located at the same plane they would not overlap or define only a small overlap area. Thus, the trajectory of planar ground pattern on a plane of the first planar conductive pattern 100 would not substantially overlap first planar conductive pattern 100, but this is not necessarily so.

Figure 6:
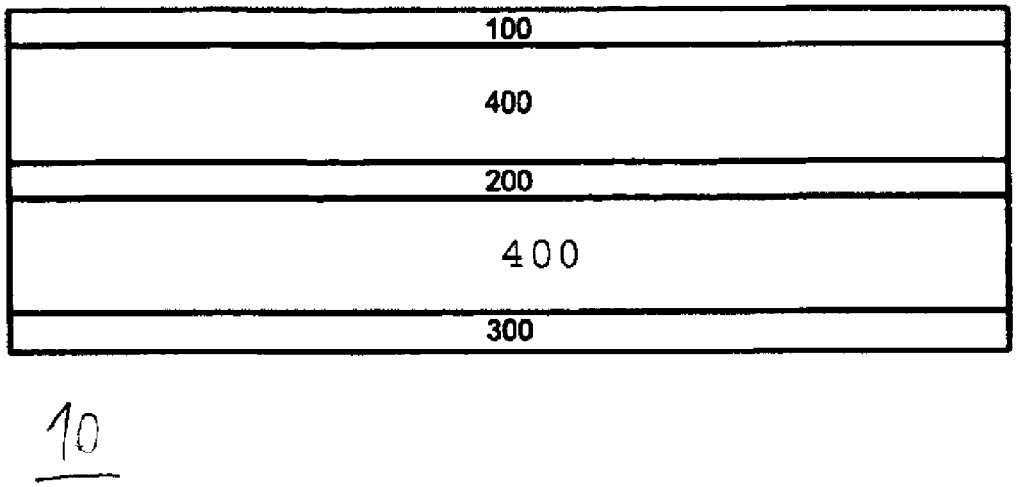
FIG. 6 illustrates a first planar conductive pattern, a second planar conductive pattern, two nonconductive layers and a ground planar pattern, according to an embodiment of the invention.
Figure 7:
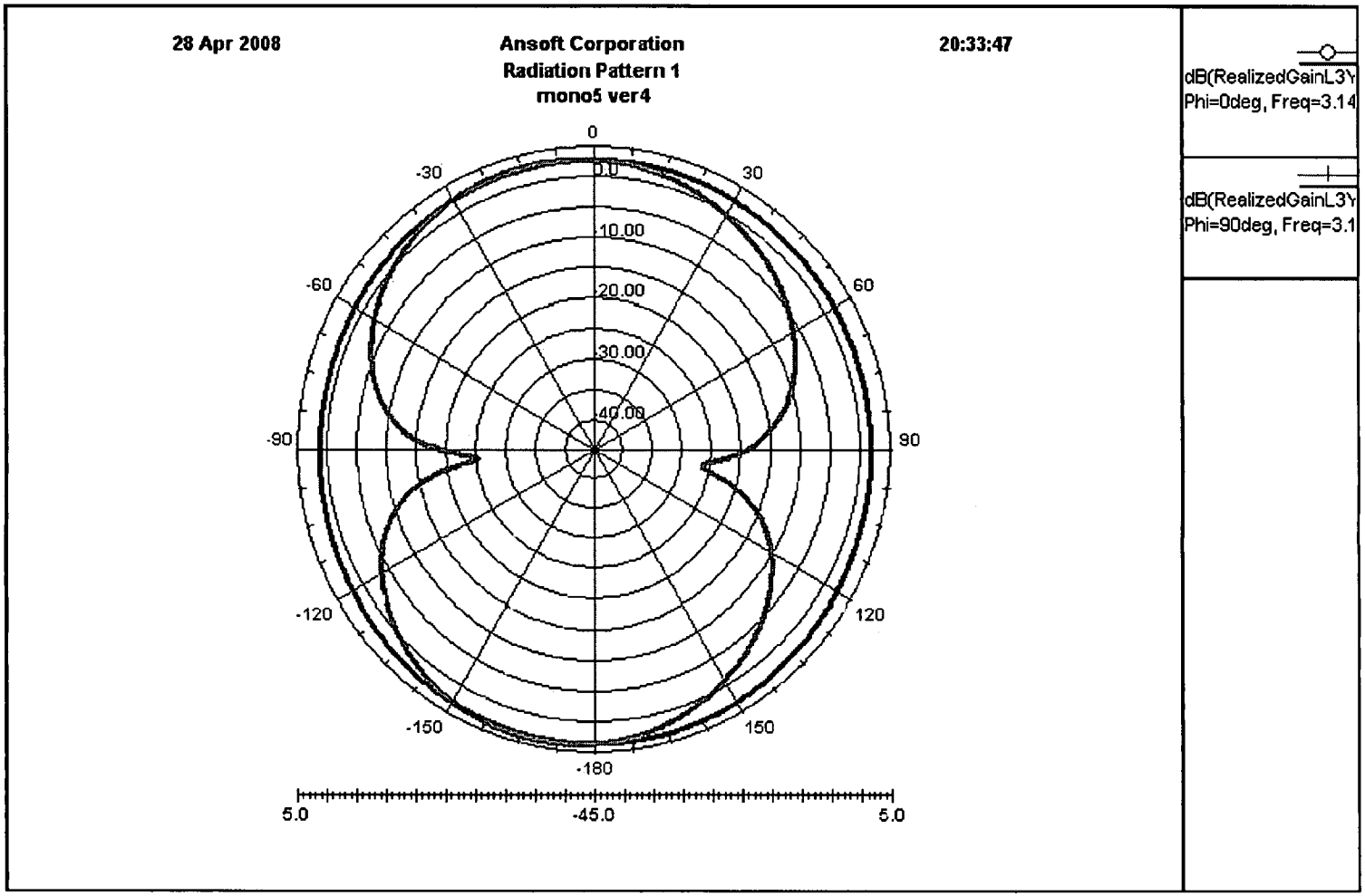
FIG. 7-FIG. 10 are radiation pattern obtained when providing broadband radio frequency signals to the first planar conductive pattern, according to an embodiment of the invention.
Figure 8:
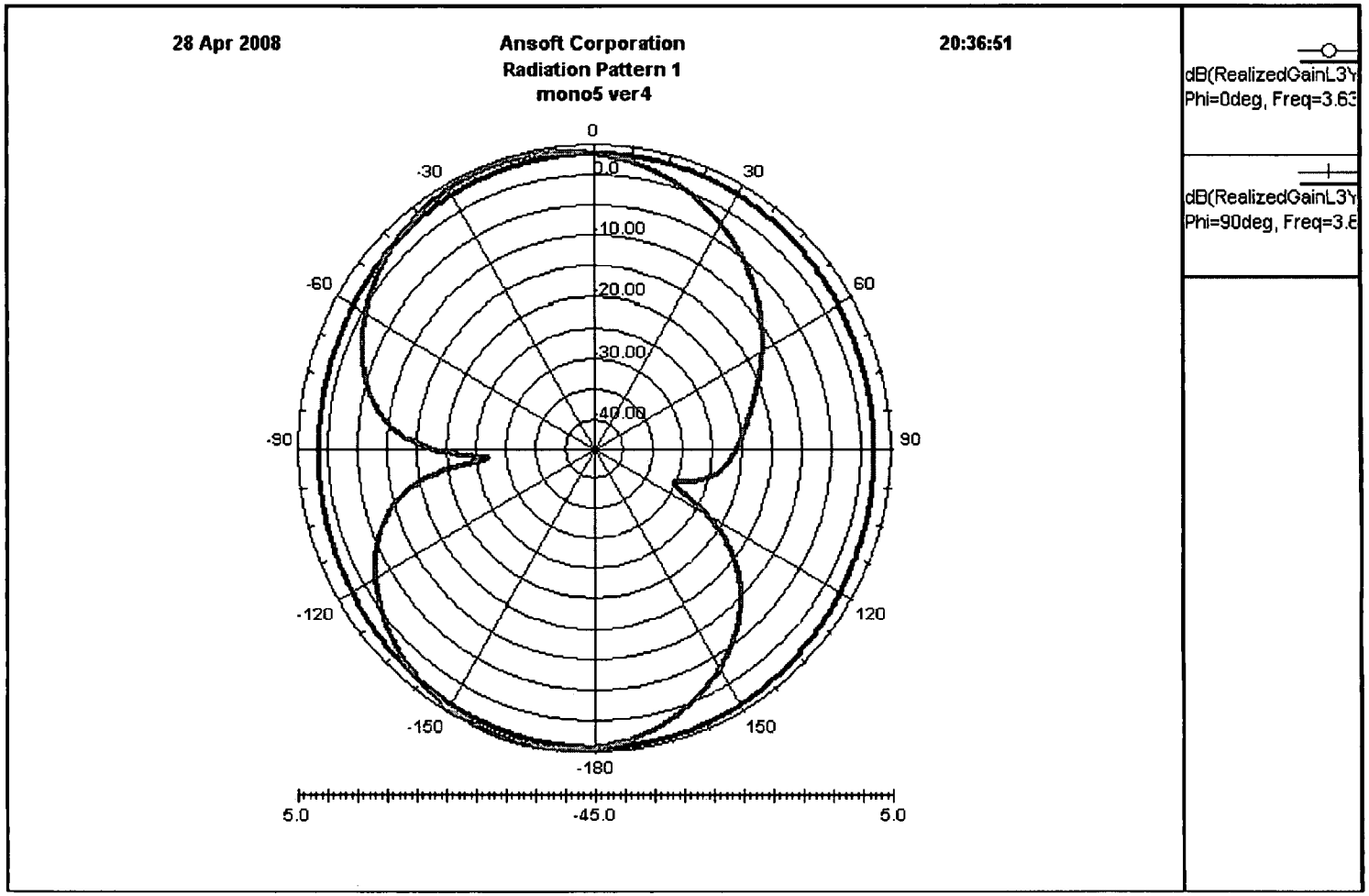
Figure 9:
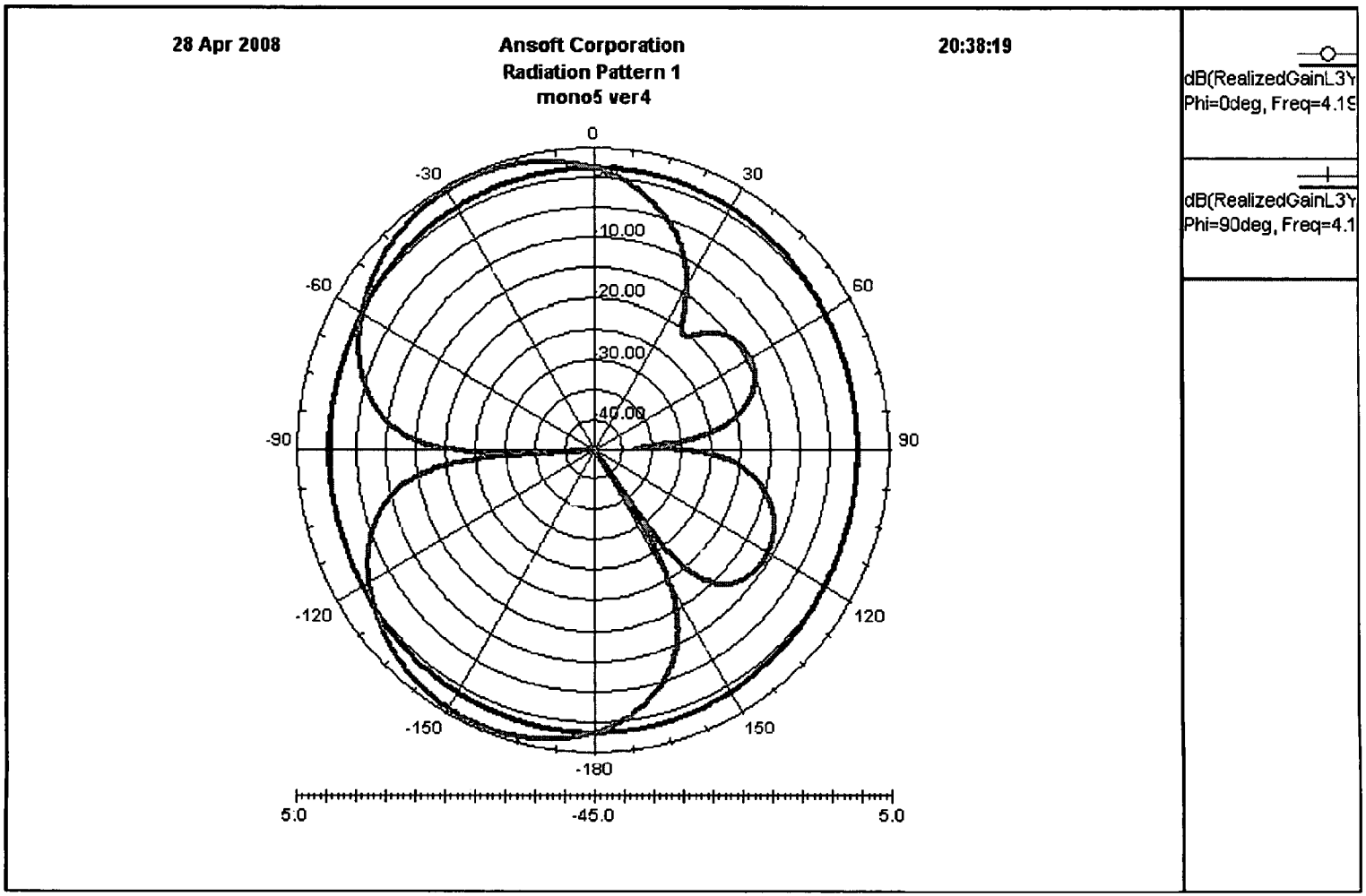
Figure 10:
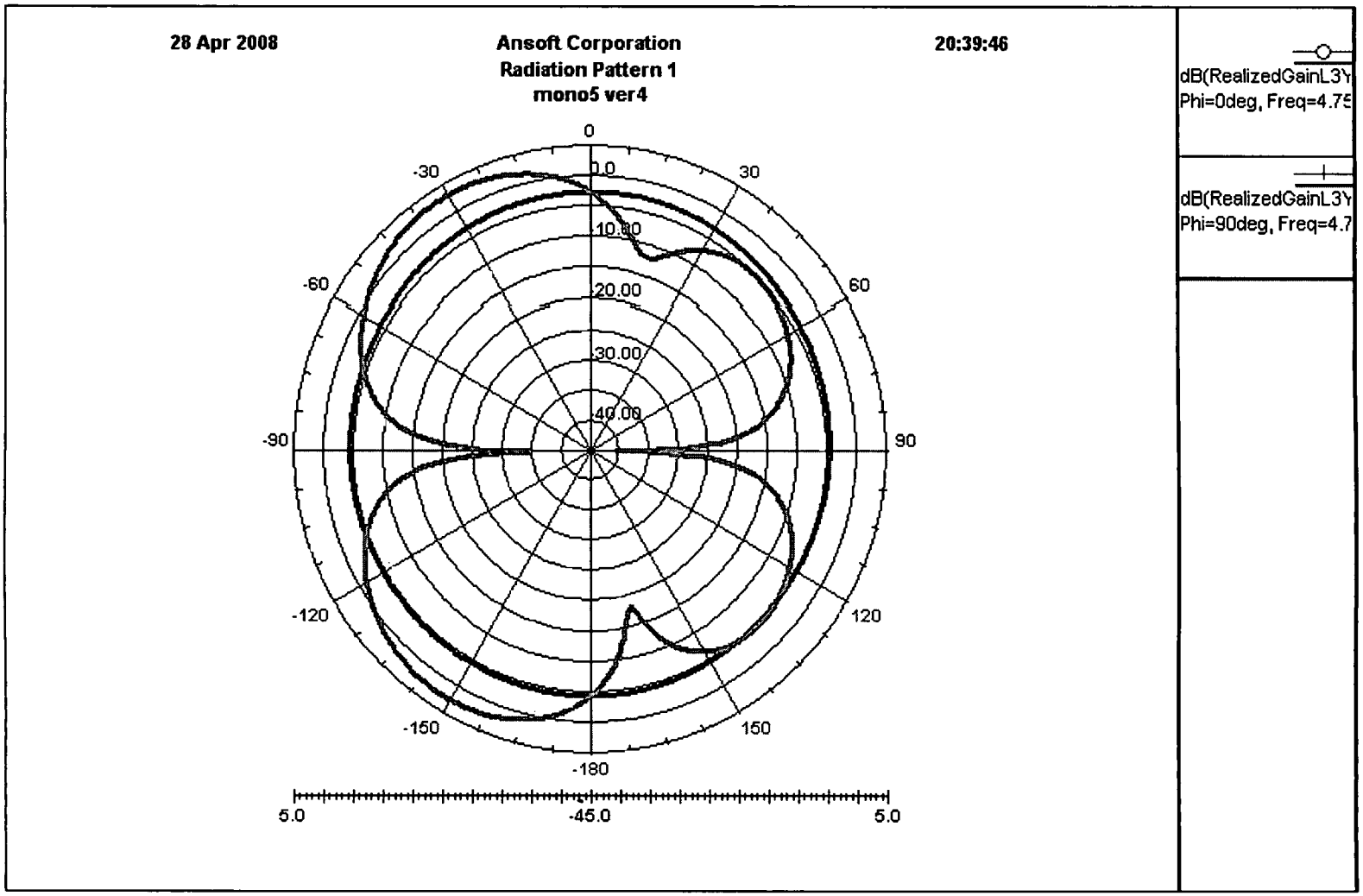
Figure 11:
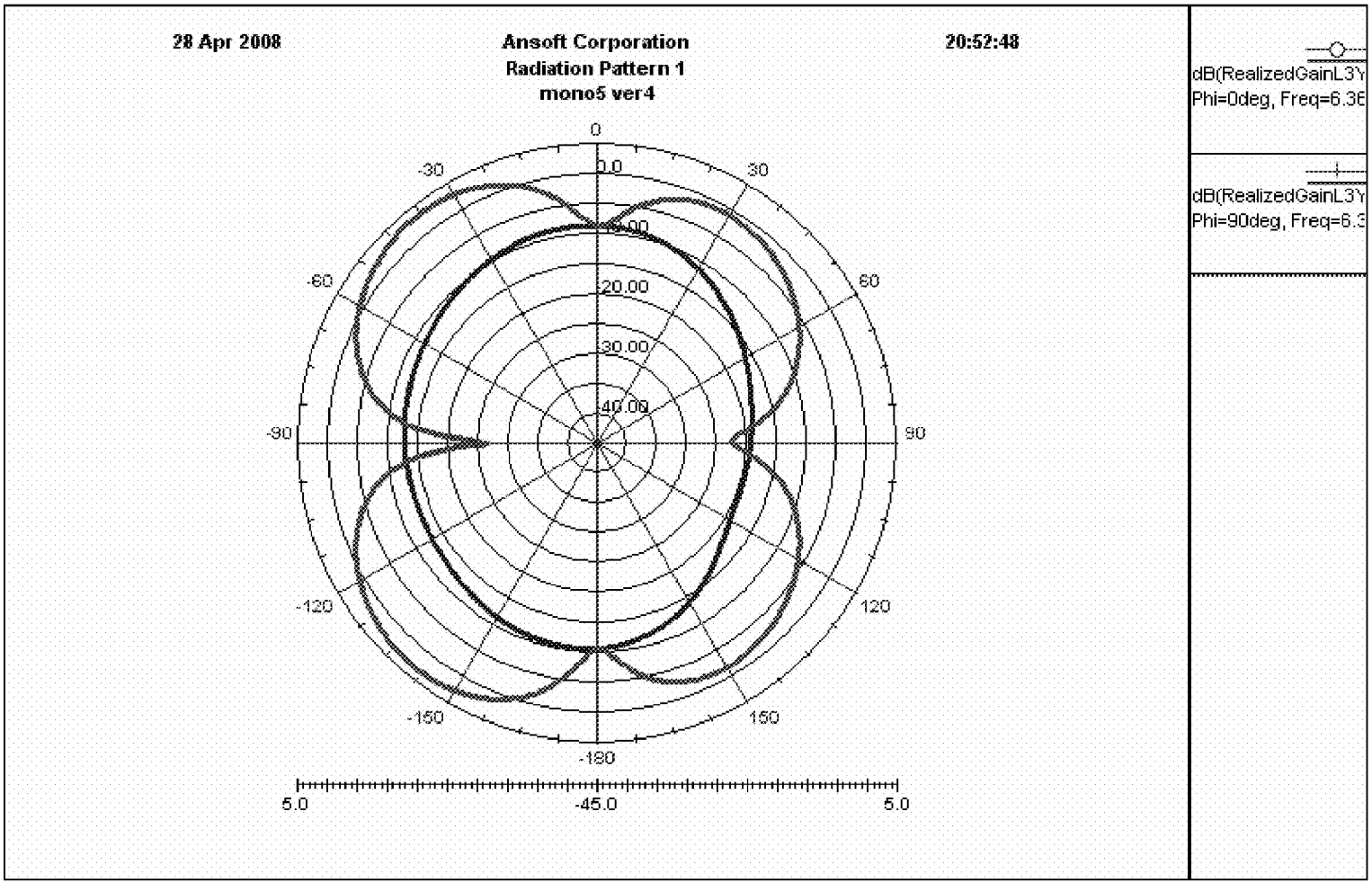
FIG. 11-FIG. 15 are radiation pattern obtained when providing broadband radio frequency signals to the second planar conductive pattern, according to an embodiment of the invention.
Figure 12:
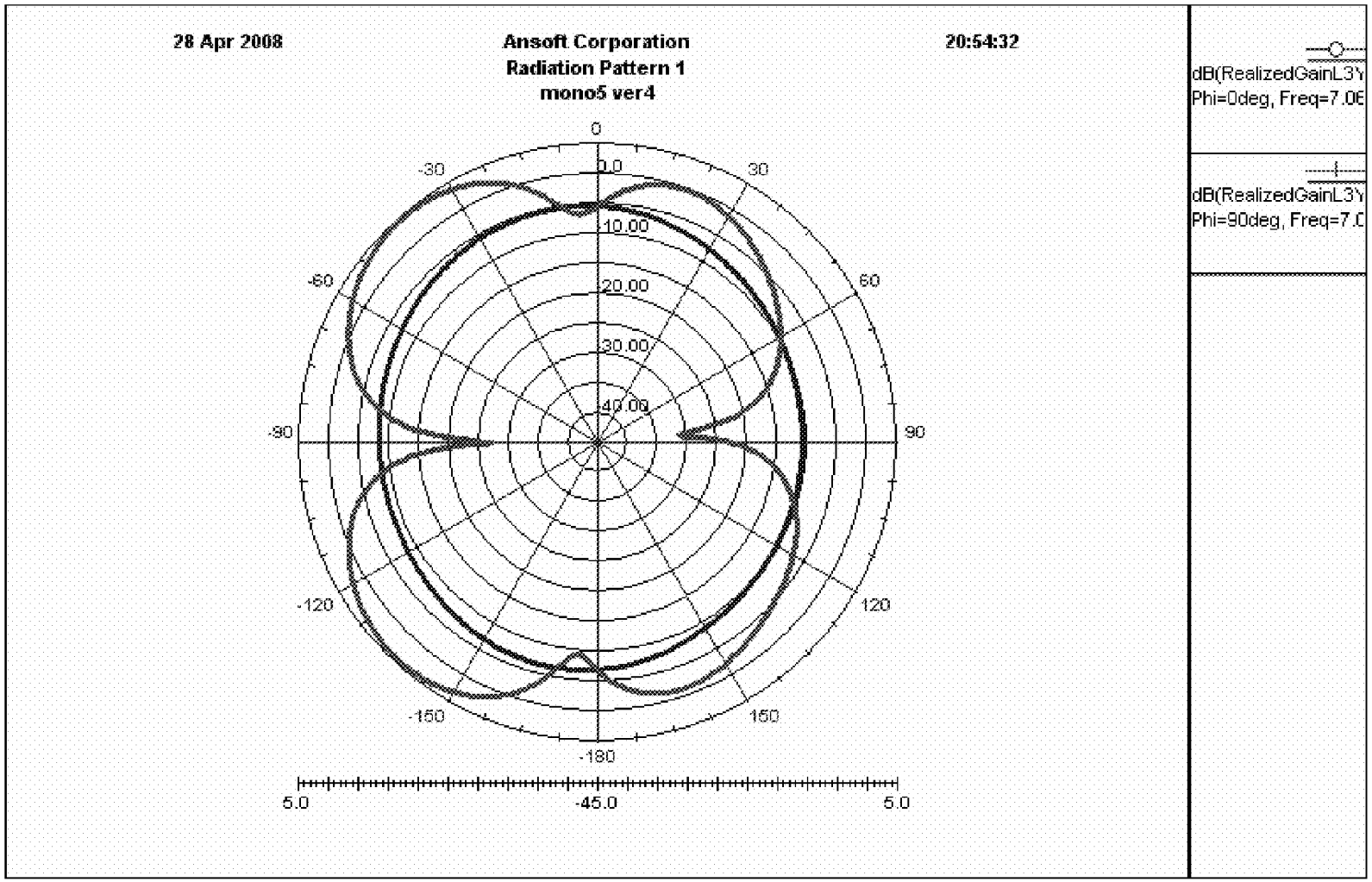
Figure 13:
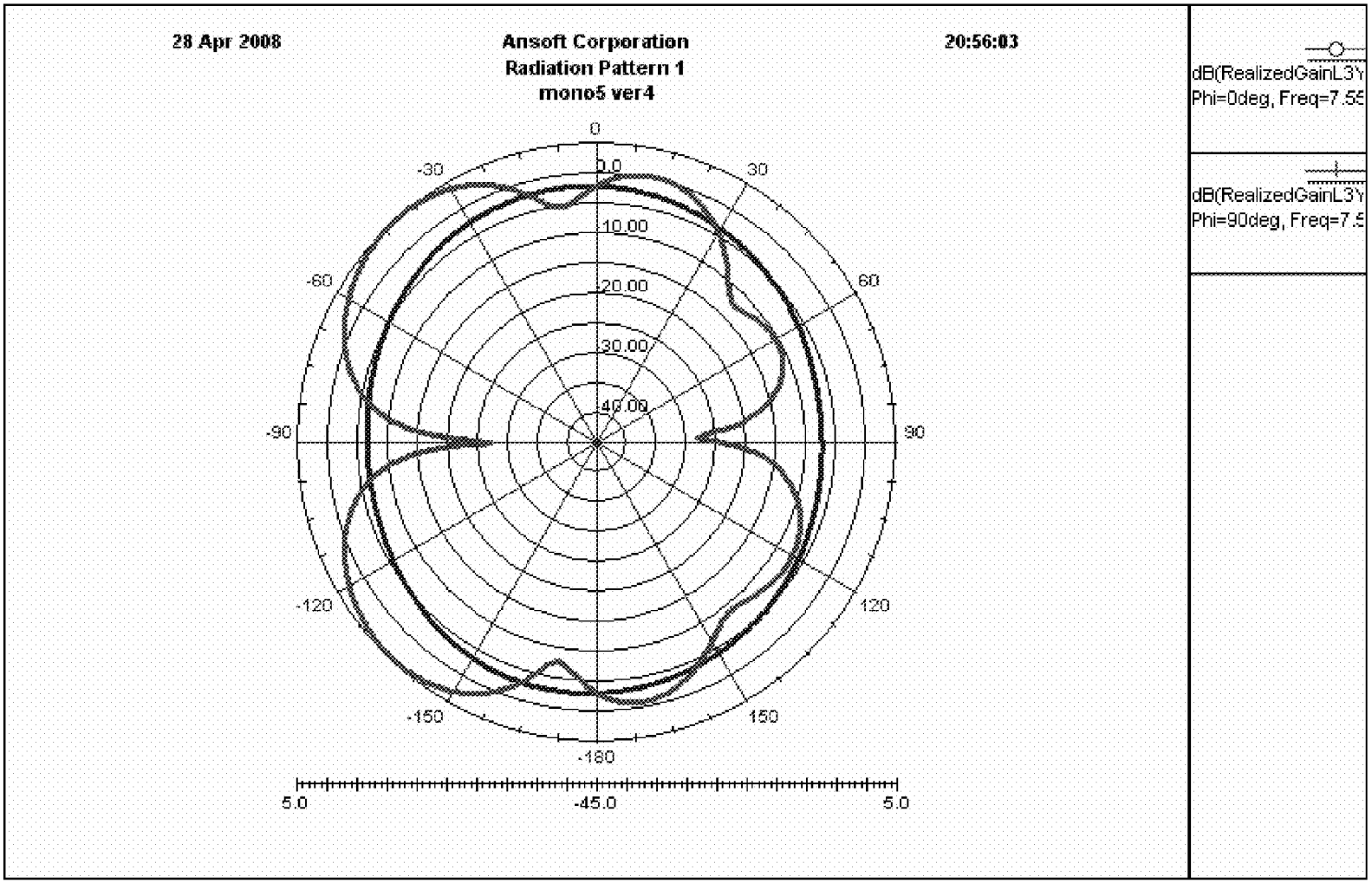
Figure 14:
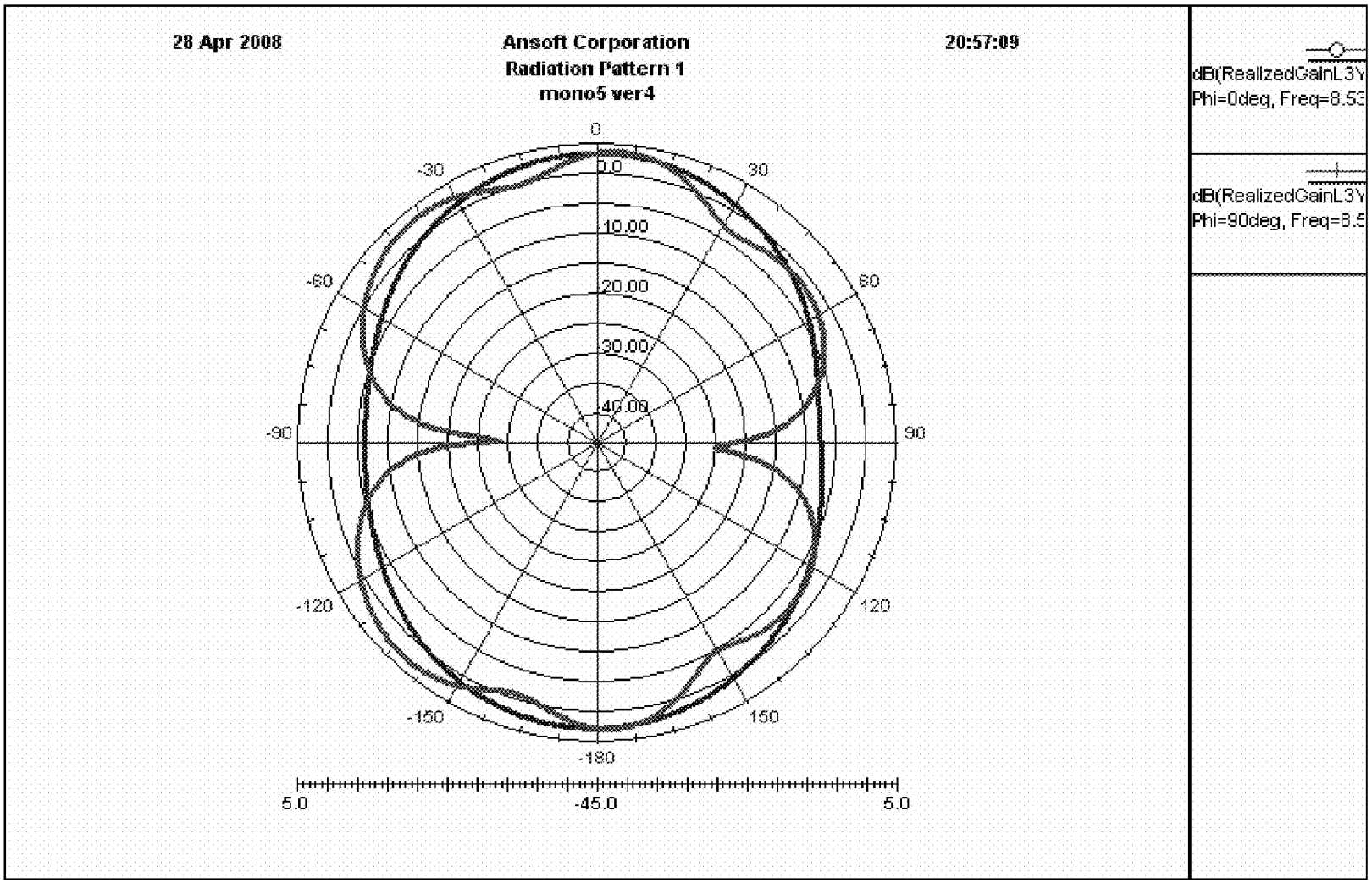
Figure 15:
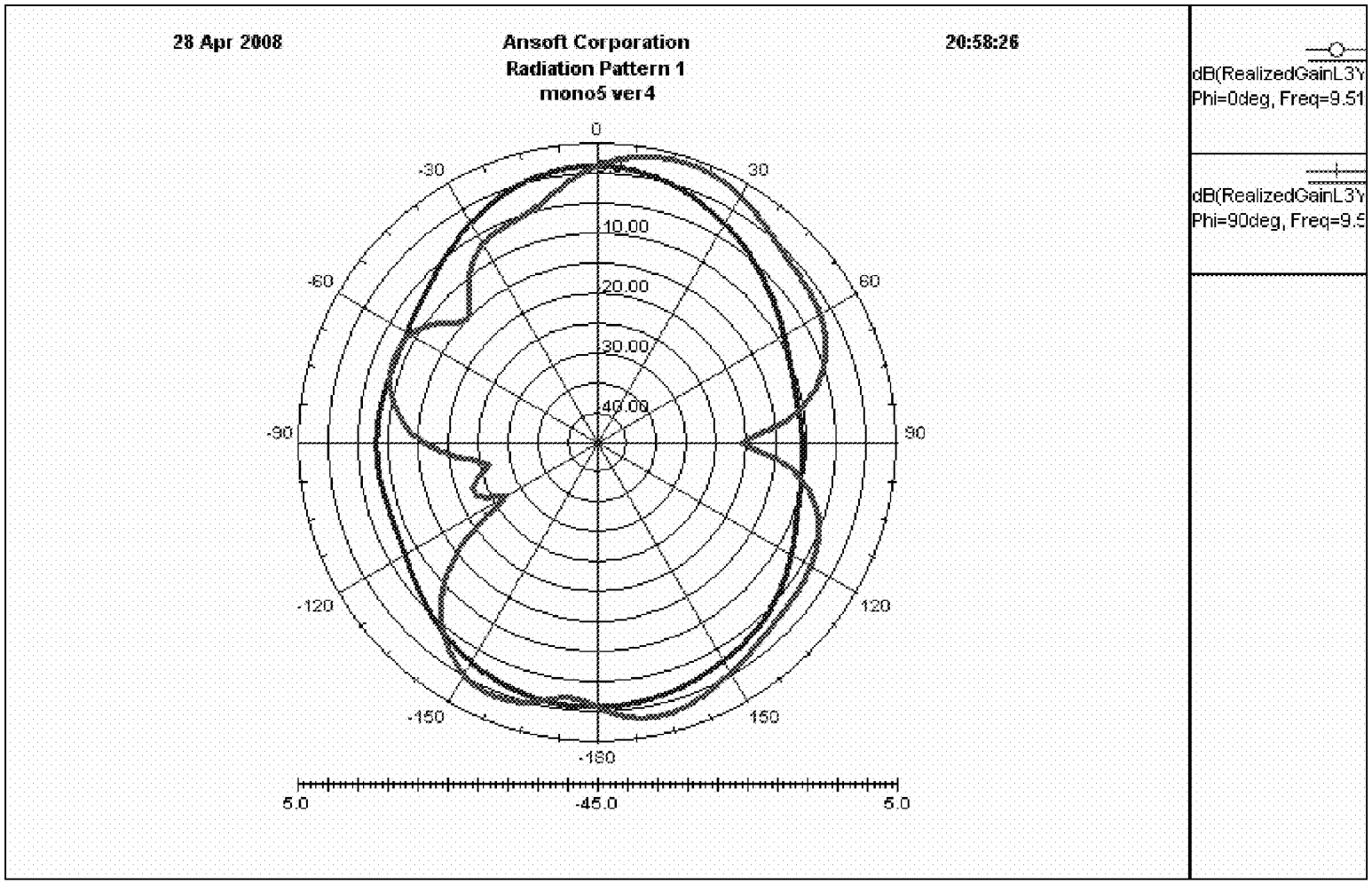
Figure 16:
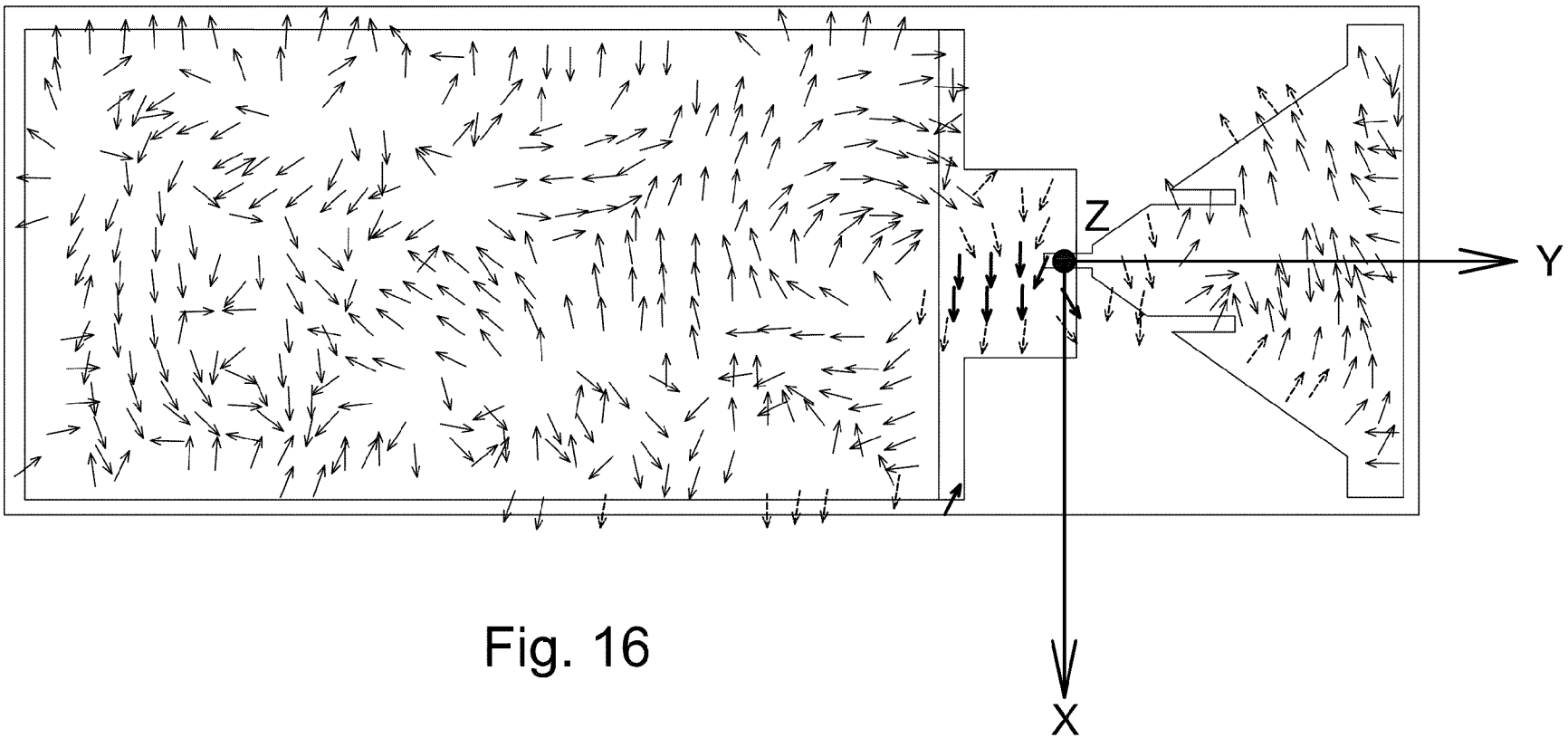
FIG. 16-FIG. 18 are simulation results of surface currents generated at one or more planar conductive patterns, according to an embodiment of the invention.
Figure 17:
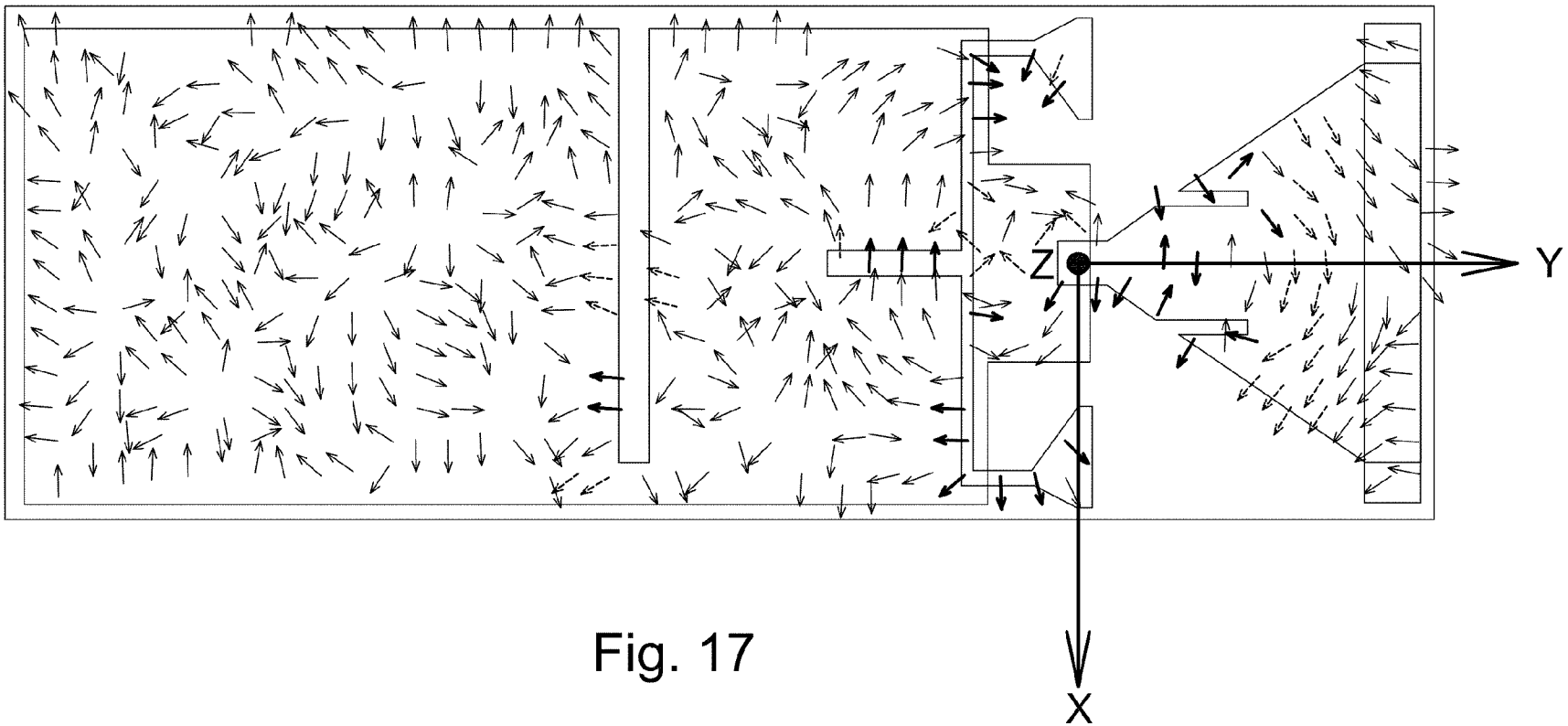
Figure 18:
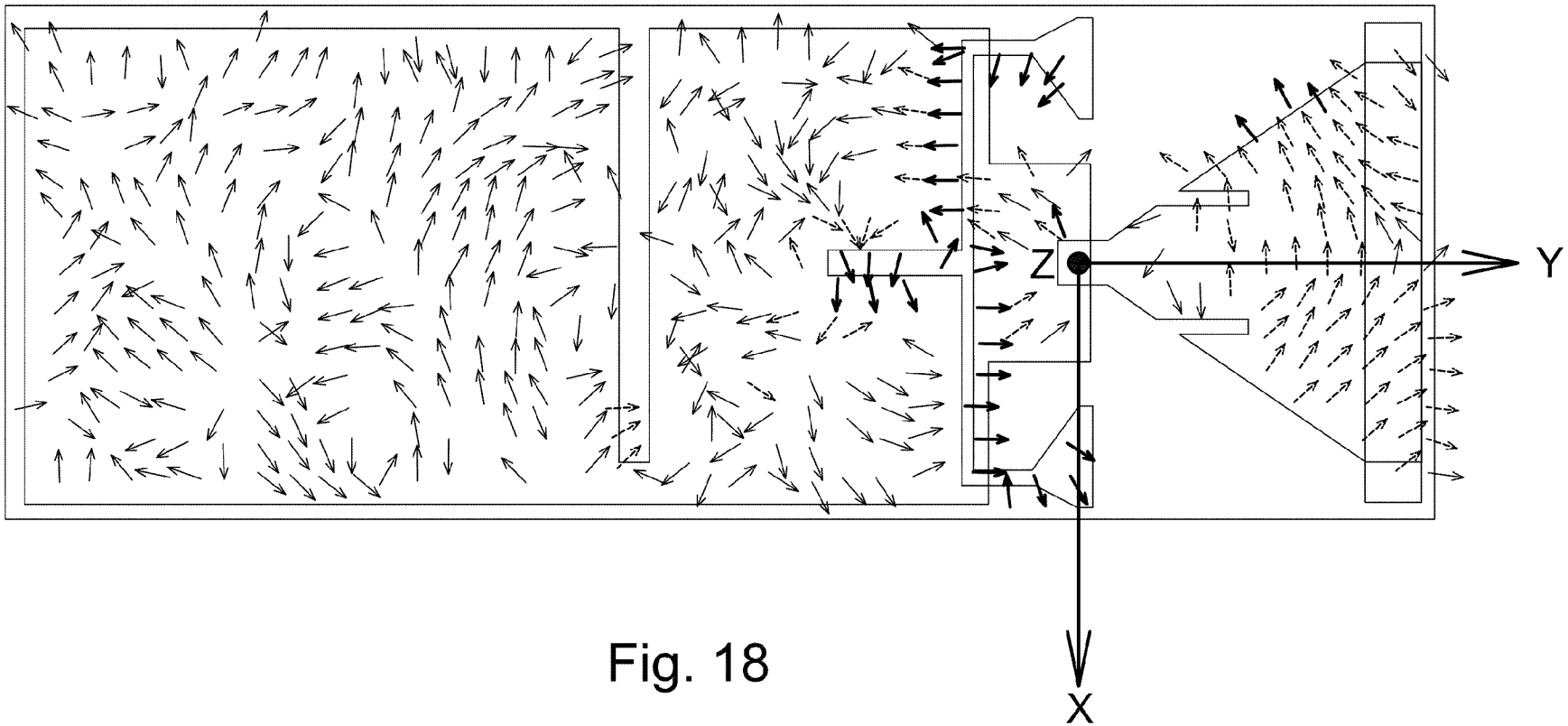

The example of FIG. 6 which is a side view of broadband radiating device 10 illustrates that planar nonconductive element 400 (such as a dielectric layer) separates between first planar conductive pattern 100 and planar ground pattern 200.

The inventor found that first planar conductive pattern 100 and the planar ground pattern 200 are shaped and positioned to generate a radiation pattern that is substantially symmetrical in relation to a plane of the planar nonconductive element.

The inventors found out that a radiation gain of the broadband radiating device, within a wide frequency range that ranges between 3 to 5 Gigahertz, increases with an increase of a frequency of broadband radio frequency signals provided to the feeding area. This increment can compensate for degradation in the gain of radio frequency components of the electrical circuit, and additionally or alternatively, of a wireless channel through which the radiation is transmitted. Conveniently, the overall transfer function of the radiation (including the antenna and at least one out of a wireless channel and the radio frequency components of an electrical circuit) can be "flat" or substantially flat—it remains almost the same over a large frequency range.

The inventors have found that first planar conductive pattern 100 and planar ground pattern 200 suppress radiation emitted from a local oscillator of an electrical circuit coupled to the feeding area. In the example of FIG. 1, this local oscillator was positioned as a far end of the device, near radio frequency front end 220.

Figure 3:
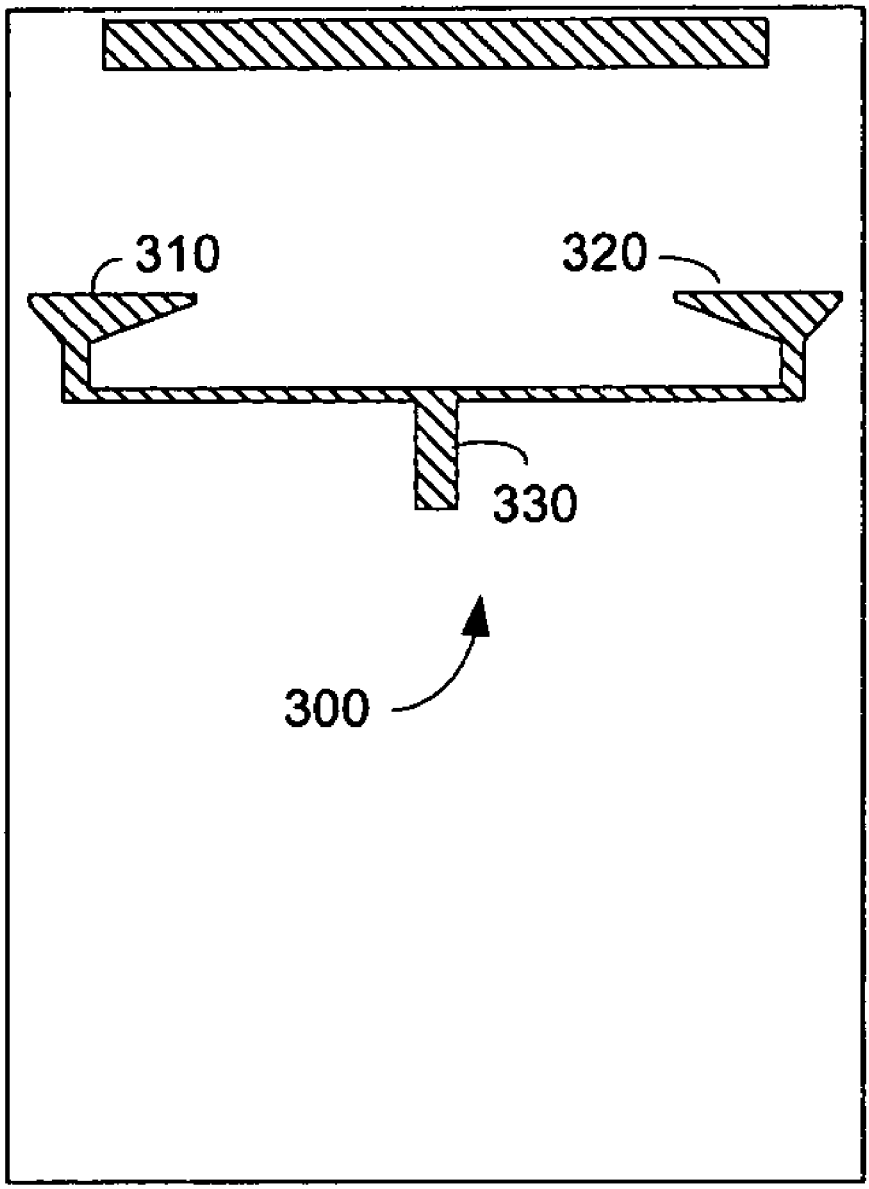
FIG. 3 illustrates a first planar conductive pattern, according to an embodiment of the invention.
Figure 4:
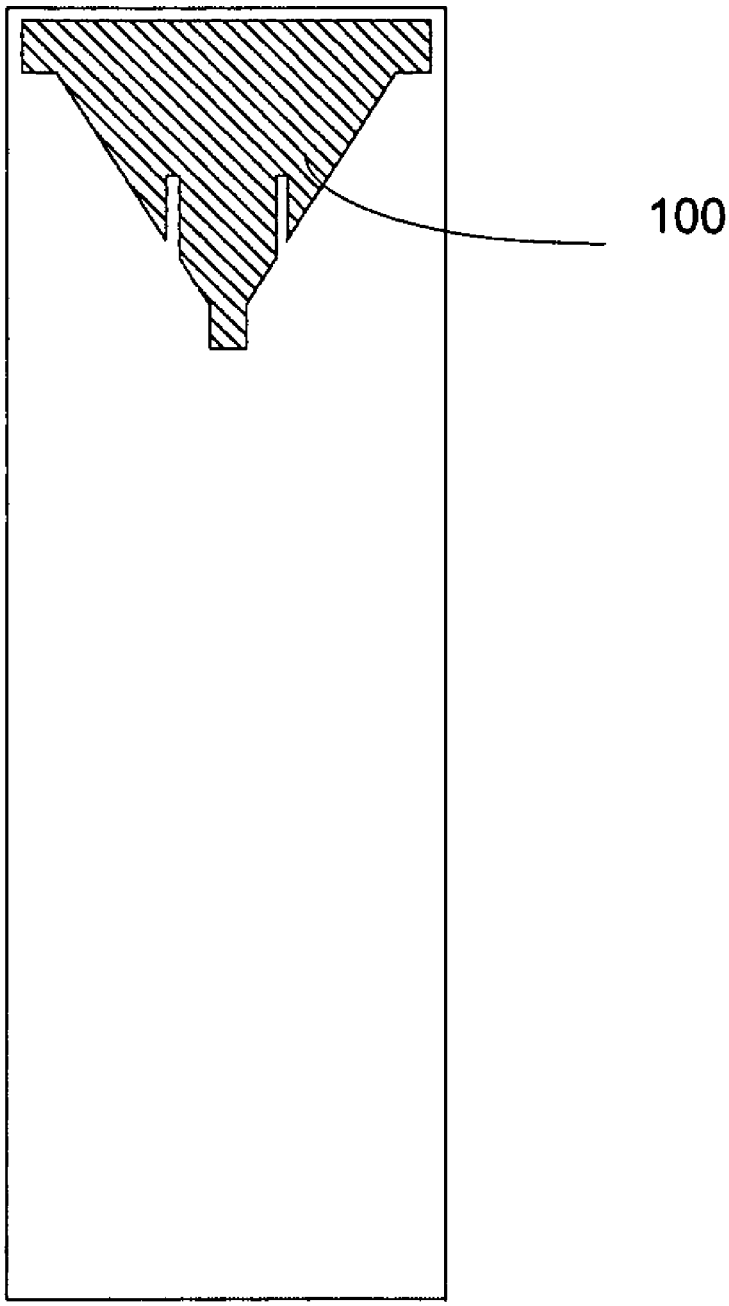
FIG. 4 illustrates a second planar conductive pattern, according to an embodiment of the invention.
Figure 5:
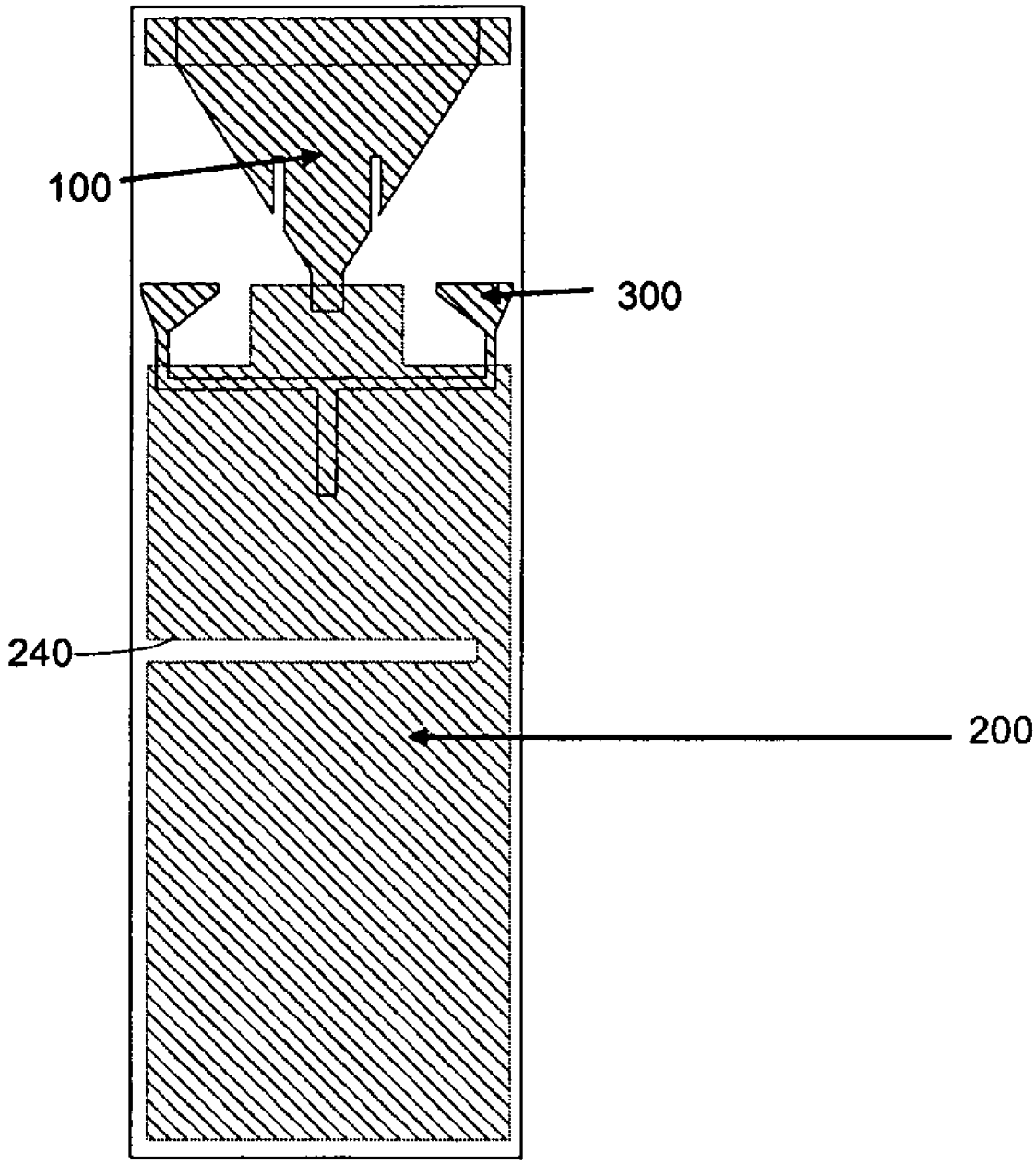
FIG. 5 illustrates a first planar conductive pattern, a second planar conductive pattern and a ground planar pattern, according to an embodiment of the invention.

Referring to the examples set fourth in FIGS. 3, 5 and 6, the broadband radiating device also includes second planar conductive pattern 300 that is substantially parallel to first planar conductive pattern 100. Second planar conductive pattern 300 operates at a frequency range that differs from a frequency range of first planar conductive pattern 100. For example, while second planar conductive pattern 300 operates at a frequency range that ranges between 6 to 9 Gigahertz, first planar conductive pattern 100 operates at a frequency range that ranges between 3 to 5 Gigahertz.

According to an embodiment of the invention at least one slot, such as slot 240 is formed in planar ground pattern 200. It is proximate to feeding area 110 of first planar conductive pattern 100.

A distance between the at least one slot and the feeding area 110 of the first planar conductive pattern 100 can be less than half a wavelength of a frequency range of the first planar conductive pattern and is more that half a wavelength of the frequency range of the second planar conductive.

The one or more slots formed in planar ground pattern 200 limits a current flux that flows through the planar ground pattern as a response of a provision of broadband radio frequency signals to first planar conductive pattern 100. Conveniently it does not affect the higher frequency response (higher refers to a frequency within the operational range of second conducting pattern 300) as it is far enough (in terms of wavelengths of the higher frequency) from second conducting pattern 300.

Second planar conductive pattern 300 can include two spaced apart planar conductive portions 310 and 320, wherein each of the spaced apart planar conductive portion includes an asymmetrical trapezoid portion that is connected, at a wide side, to a rectangular portion and is connected, at its narrow side, to splitter 330. Splitter 330 can include a T-shaped portion that splits broadband radio frequency signals provided to its base.

Second planar conductive pattern 200 can include two spaced apart planar conductive portions that are located at two opposite sides of a symmetry axis of symmetrical trapezoid portion 102 of the first planar conductive pattern 100.

The inventors found that the combination of first planar conductive pattern 100, second planar conductive pattern 300 and planar ground pattern 200 acts as a dipole antenna at one frequency range (or frequency sub-range) and acts as a monopole antenna another frequency range (of another frequency sub-range).

The inventors found that the combination of first planar conductive pattern 100, second planar conductive pattern 300 and planar ground pattern 200 generate a radiation pattern that is substantially symmetrical in relation to a plane of the planar nonconductive element. Samples of radiation patterns are provided in FIG. 7-FIG. 15. In these figures the various planar patterns are horizontal—within an x-y plane.

It is noted that the radiation patterns can be substantially omni-directional.

Various methods for broadband transmission can be provided. These include providing broadband radio frequency signals to one or more of the planar conductive elements and in response transmitting a broadband radio frequency radiation by at least that planar conductive element. Due to the proximity between the various planar elements (for example, 100, 200 and 300) patterns that do not receive the broadband radio frequency signals affect the radiation pattern.

Each method can use any of the mentioned above elements and embodiments.

Figure 19:
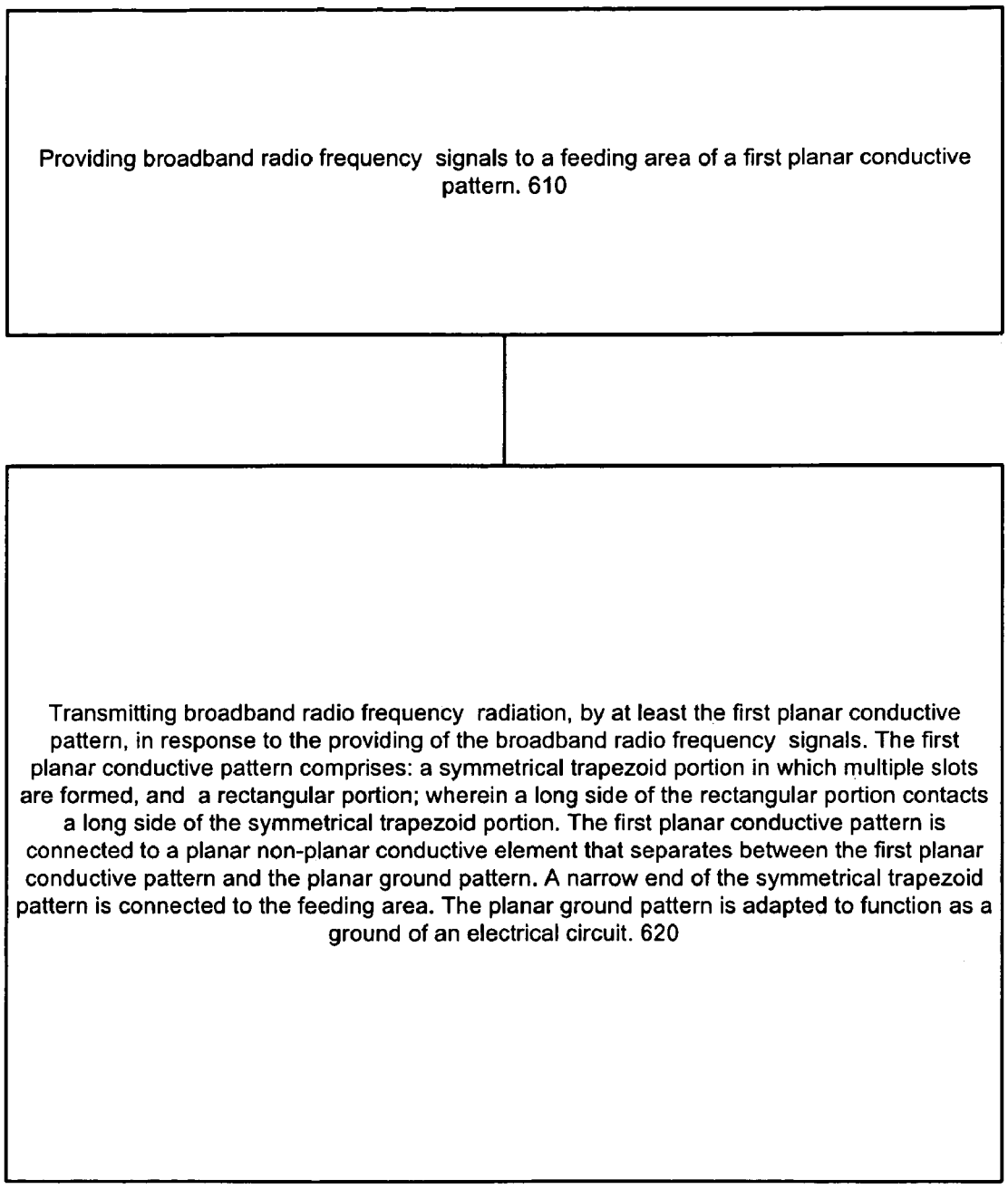
FIG. 19 is a flow chart of a method according to an embodiment of the invention.

FIG. 19 is a flow chart of method 600 according to an embodiment of the invention.

Method 600 starts by stage 610 of providing broadband radio frequency signals to a feeding area of a first planar conductive pattern.

Stage 610 is followed by stage 620 of transmitting broadband radio frequency radiation, by at least the first planar conductive pattern, in response to the provision of the broadband radio frequency signals. The first planar conductive pattern comprises: a symmetrical trapezoid portion in which multiple slots are formed, and a rectangular portion; wherein a long side of the rectangular portion contacts a long side of the symmetrical trapezoid portion. The first planar conductive pattern is connected to a planar non conductive element that separates between the first planar conductive pattern and the planar ground pattern. A narrow end of the symmetrical trapezoid pattern is connected to the feeding area. The planar ground pattern is adapted to function as a ground of an electrical circuit.

Figure 20:
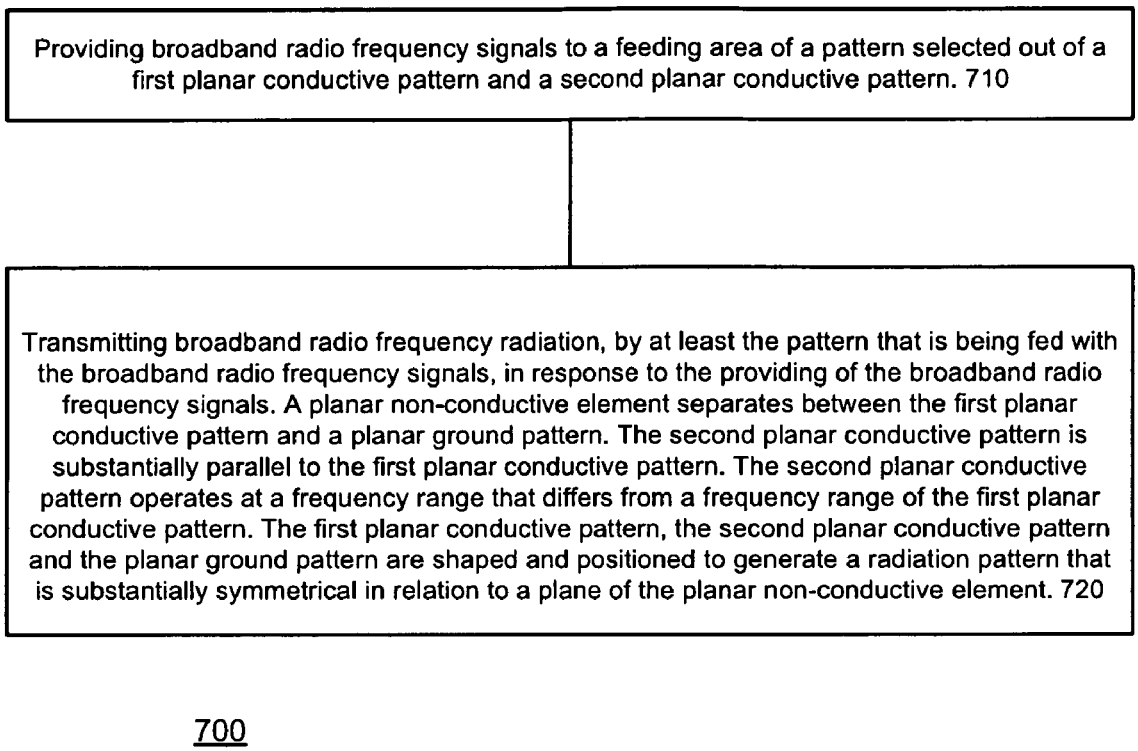
FIG. 20 is a flow chart of a method according to an embodiment of the invention.

FIG. 20 is a flow chart of method 700 according to an embodiment of the invention.

Method 700 starts by stage 710 of providing broadband radio frequency signals to a feeding area of a pattern selected out of a first planar conductive pattern and a second planar conductive pattern.

Stage 710 is followed by stage 720 of transmitting broadband radio frequency radiation, by at least the pattern that is being fed with the broadband radio frequency signals, in response to the provision of the broadband radio frequency signals. A planar non-conductive element separates between the first planar conductive pattern and a planar ground pattern. The second planar conductive pattern is substantially parallel to the first planar conductive pattern. The second planar conductive pattern operates at a frequency range that differs from a frequency range of the first planar conductive pattern. The first planar conductive pattern, the second planar conductive pattern and the planar ground pattern are shaped and positioned to generate a radiation pattern that is substantially symmetrical in relation to a plane of the planar non-conductive element.

Thus, it is to be understood that the architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

However, other modifications, variations, and alternatives are also possible. The specifications and drawings are, accordingly, to be regarded in an illustrative rather than in a restrictive sense.

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

The principles and uses of the teachings of the present invention may be better understood with reference to the accompanying description, figures and examples. In the figures, like reference numerals refer to like parts throughout.

Furthermore, those skilled in the art will recognize that boundaries between the functionality of the above described operations are merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

The word 'comprising' does not exclude the presence of other elements or steps then those listed in a claim.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

We claim:

1. A broadband radiating device, comprising:

a first planar conductive pattern that comprises:

a symmetrical trapezoid portion in which multiple slots are formed, and a rectangular portion, wherein a long side of the rectangular portion contacts a long side of the symmetrical trapezoid portion;

a planar ground pattern; and a planar nonconductive element that separates between the first planar conductive pattern and the planar ground pattern;

wherein a narrow end of the symmetrical trapezoid pattern is connected to a feeding area; and wherein the planar ground pattern is adapted to function as a ground of an electrical circuit.

2. The broadband radiating device according to claim 1 wherein two rectangular shaped slots are formed in the symmetrical trapezoid portion wherein each rectangular shaped slot has a longitudinal axis that is substantially perpendicular to the long side of the symmetrical trapezoid portion.

3. The broadband radiating device according to claim 1 wherein an area of the planar ground pattern is larger than an area of the first planar conductive pattern.

4. The broadband radiating device according to claim 1 wherein the first planar conductive pattern and the planar ground pattern are shaped and positioned to generate a radiation pattern that is substantially symmetrical in relation to a plane of the planar non-conductive element.

5. The broadband radiating device according to claim 1 wherein a radiation gain of the broadband radiating device, within a wide frequency range, increases with an increase of a frequency of broadband radio frequency signals provided to the feeding area.

6. The broadband radiating device according to claim 1 wherein the first planar conductive pattern and the planar ground pattern are shaped and positioned to suppress radiation emitted from a local oscillator of an electrical circuit coupled to the feeding area.

7. The broadband radiating device according to claim 1 further comprising a second planar conductive pattern that is substantially parallel to the first planar conductive pattern; wherein the second planar conductive pattern operates at a frequency range that differs from a frequency range of the first planar conductive pattern.

8. The broadband radiating device according to claim 7 wherein at least one slot is formed in the planar ground pattern; wherein the at least one slot is proximate to the feeding area of the first planar conductive pattern.

9. The broadband radiating device according to claim 7 wherein at least one slot is formed in the planar ground pattern; wherein a distance between the at least one slot and the feeding area of the first planar conductive pattern is less than half a wavelength of a frequency range of the first planar conductive pattern and is more than half a wavelength of the frequency range of the second planar conductive.

10. The broadband radiating device according to claim 7 wherein at least one slot is formed in the planar ground pattern; wherein the at least one slot is positioned and shaped to limit a current flux that flows through the planar ground pattern as a response of a provision of broadband radio frequency signals to the first planar conductive pattern.

11. The broadband radiating device according to claim 7 wherein the second planar conductive pattern comprises two spaced apart planar conductive portions; wherein each of the spaced apart planar conductive portion comprises an asymmetrical trapezoid portion that is coupled, at a wide side, to a rectangular portion and is coupled, at a narrow side, to a splitter.

12. The broadband radiating device according to claim 7 wherein the first planar conductive pattern, the second planar conductive pattern and the planar ground pattern act as a dipole antenna at one frequency range and act as a monopole antenna at another frequency range.

13. The broadband radiating device according to claim 7 wherein the second planar conductive pattern comprises two spaced apart planar conductive portions that are located at two opposite sides of a symmetry axis of the symmetrical trapezoid portion of the first planar conductive pattern.

14. The broadband radiating device according to claim 7 wherein the first planar conductive element operates at a frequency range that spans between 3 and 5 Gigahertz and wherein the second planar conductive element operates at a frequency range that spans between 6 and 9 Gigahertz.

15. The broadband radiating device according to claim 7 wherein the first planar conductive pattern, the second planar conductive pattern and the planar ground pattern are shaped and positioned to generate a radiation pattern that is substantially symmetrical in relation to a plane of the planar nonconductive element.

16. A broadband radiating device, comprising:

a first planar conductive pattern;

a planar ground pattern;

a planar nonconductive element that separates between the first planar conductive pattern and the planar ground pattern; and a second planar conductive pattern that is substantially parallel to the first planar conductive pattern;

wherein the second planar conductive pattern operates at a frequency range that differs from a frequency range of the first planar conductive pattern; and wherein the first planar conductive pattern, the second planar conductive pattern and the planar ground pattern are shaped and positioned to generate a radiation pattern that is substantially symmetrical in relation to a plane of the planar nonconductive element.

17. The broadband radiating device according to claim 16 wherein the first planar conductive pattern comprises a symmetrical trapezoid portion in which multiple slots are formed.

18. A method, comprising:

providing broadband radio frequency signals to a feeding area of a first planar conductive pattern; and transmitting broadband radio frequency radiation, by at least the first planar conductive pattern, in response to the providing of the broadband radio frequency signals;

wherein the first planar conductive pattern comprises: a symmetrical trapezoid portion in which multiple slots are formed, and a rectangular portion; wherein a long side of the rectangular portion contacts a long side of the symmetrical trapezoid portion;

wherein the first planar conductive pattern is connected to a planar nonconductive element that separates between the first planar conductive pattern and the planar ground pattern;

wherein a narrow end of the symmetrical trapezoid pattern is connected to the feeding area; and wherein the planar ground pattern is adapted to function as a ground of an electrical circuit.

19. The method according to claim 18 wherein two rectangular shaped slots are formed in the symmetrical trapezoid portion wherein each rectangular shaped slot has a longitudinal axis that is substantially perpendicular to the long side of the symmetrical trapezoid portion.

20. The method according to claim 18 wherein an area of the planar ground pattern is larger than an area of the first planar conductive pattern.

21. The method according to claim 18 wherein the first planar conductive pattern and the planar ground pattern are shaped and positioned to generate a radiation pattern that is substantially symmetrical in relation to a plane of the planar nonconductive element.

22. The method according to claim 18 wherein a radiation gain of the method, within a wide frequency range, increases with an increase of a frequency of broadband radio frequency signals provided to the feeding area.

23. The method according to claim 18 wherein the first planar conductive pattern and the planar ground pattern are shaped and positioned to suppress radiation emitted from a local oscillator of an electrical circuit coupled to the feeding area.

24. The method according to claim 18 further comprising providing broadband radio frequency signals to a patterns elected from the first planar conductive pattern and a second planar conductive pattern that is substantially parallel to the first planar conductive pattern; wherein the second planar conductive pattern operates at a frequency range that differs from a frequency range of the first planar conductive pattern.

25. The method according to claim 24 wherein at least one slot is formed in the planar ground pattern; wherein the at least one slot is proximate to the feeding area of the first planar conductive pattern.

26. The method according to claim 24 wherein at least one slot is formed in the planar ground pattern; wherein a distance between the at least one slot and the feeding area of the first planar conductive pattern is less than half a wavelength of a frequency range of the first planar conductive pattern and is more that half a wavelength of the frequency range of the second planar conductive.

27. The method according to claim 24 wherein at least one slot is formed in the planar ground pattern; wherein the at least one slot is positioned and shaped to limit a current flux that flows through the planar ground pattern as a response of a provision of radio frequency signals to the first planar conductive pattern.

28. The method according to claim 24 wherein the second planar conductive pattern comprises two spaced apart planar conductive portions; wherein each of the spaced apart planar conductive portion comprises an asymmetrical trapezoid portion that is coupled, at a wide side, to a rectangular portion and is coupled, at a narrow side, to a splitter.

29. The method according to claim 24 wherein the first planar conductive pattern, the second planar conductive pattern and the planar ground pattern act as a dipole antenna at one frequency range and act as a monopole antenna at another frequency range.

30. The method according to claim 24 wherein the second planar conductive pattern comprises two spaced apart planar conductive portions that are located at two opposite sides of a symmetry axis of the symmetrical trapezoid portion of the first planar conductive pattern.

31. The method according to claim 24 wherein the first planar conductive element operates at a frequency range that spans between 3 and 5 Gigahertz and wherein the second planar conductive element operates at a frequency range that spans between 6 and 9 Gigahertz.

32. The method according to claim 24 wherein the first planar conductive pattern, the second planar conductive pattern and the planar ground pattern are shaped and positioned to generate a radiation pattern that is substantially symmetrical in relation to a plane of the planar nonconductive element.

33. A method, comprising:

providing broadband radio frequency signals to a feeding area of a pattern selected out of a first planar conductive pattern and a second planar conductive pattern; and transmitting broadband radio frequency radiation, by at least the pattern that is being fed with the broadband radio frequency signals, in response to the providing of the broadband radio frequency signals;

wherein a planar nonconductive element separates between the first planar conductive pattern and a planar ground pattern;

wherein the second planar conductive pattern is substantially parallel to the first planar conductive pattern;

wherein the second planar conductive pattern operates at a frequency range that differs from a frequency range of the first planar conductive pattern; and wherein the first planar conductive pattern, the second planar conductive pattern and the planar ground pattern are shaped and positioned to generate a radiation pattern that is substantially symmetrical in relation to a plane of the planar nonconductive element.

34. The method according to claim 33 wherein the first planar conductive pattern comprises a symmetrical trapezoid portion in which multiple slots are formed.

35. A broadband radiating device, comprising:

a planar conductive pattern that comprises two spaced apart planar conductive portions; wherein each of the spaced apart planar conductive portion comprises a trapezoid portion that is coupled, at a wide side, to a rectangular portion and is coupled, at a narrow side, to a splitter;

a planar ground pattern; and a planar nonconductive element that separates between the planar conductive pattern and the planar ground pattern; and wherein the planar ground pattern is adapted to function as a ground of an electrical circuit.

36. A method, comprising:

providing broadband radio frequency signals to a feeding area of a planar conductive pattern; and transmitting broadband radio frequency radiation, by at least the planar conductive pattern, in response to the providing of the broadband radio frequency signals;

wherein the first planar conductive pattern comprises two spaced apart planar conductive portions; wherein each of the spaced apart planar conductive portion comprises a trapezoid portion that is coupled, at a wide side, to a rectangular portion and is coupled, at a narrow side, to a splitter;

wherein the planar conductive pattern is connected to a planar non conductive element that separates between the planar conductive pattern and the planar ground pattern; and wherein the planar ground pattern is adapted to function as a ground of an electrical circuit.

* * * * *